United States Patent [19]

Nourse et al.

[11] Patent Number: 4,667,185

[45] Date of Patent: May 19, 1987

[54] WIRELESS SYNCHRONIZATION SYSTEM FOR ELECTRONIC ARTICLE SURVEILLANCE SYSTEM

[75] Inventors: Gary E. Nourse; James E. Fergen; Peter J. Zarembo, all of St. Paul, Minn.

[73] Assignee: Minnesota Mining and Manufacturing Company, St. Paul, Minn.

[21] Appl. No.: 805,856

[22] Filed: Dec. 6, 1985

[51] Int. Cl.[4] ..... G08B 13/18

[52] U.S. Cl. ..... 340/572; 340/551

[58] Field of Search ..... 340/572, 551

[56] References Cited

U.S. PATENT DOCUMENTS 3,740,742 6/1973 Thompson et al. ..... 340/572

3,810,172 5/1974 Burpee et al. ..... 343/5 PD 4,023,167 5/1977 Wahlstrom ..... 343/6.5 SS 4,476,459 10/1984 Cooper et al. ..... 340/572

4,531,117 7/1985 Nourse et al. ..... 340/572

*Primary Examiner*—Glen R. Swann, III

*Attorney, Agent, or Firm*—Donald M. Sell; James A. Smith; William B. Barte

[57] ABSTRACT

Operation of similar electronic article surveillance (EAS) systems in proximity to each other may result in false alarms or system "shut-downs" as a result of signals transmitted from one system being detected in the receiver circuits of the other systems. This may especially occur with EAS systems in which the receivers are only activated during quiescent intervals between transmitted bursts, such that if the systems are unsychronized, the transmitted bursts of the one system may occur during the quiescent intervals of the other system. In the present invention, synchronization is effected by responding to RF detected during the quiescent intervals and preventing the transmitted bursts from occurring during the quiescent intervals of the other system.

9 Claims, 5 Drawing Figures

WIRELESS SYNCHRONIZATION SYSTEM FOR ELECTRONIC ARTICLE SURVEILLANCE SYSTEM

FIELD OF THE INVENTION

This invention relates to electronic article surveillance (EAS) systems, particularly to such systems in which bursts of RF energy are transmitted within an interrogation zone and signals produced by markers, such as may contain a resonant circuit, in response to the radiated bursts of energy are detected during quiescent intervals between bursts.

BACKGROUND OF THE INVENTION

Systems such as are briefly described above, are disclosed in U.S. Pat. Nos. 3,740,742 (Thompson), 3,810,172 (Burpee), 4,023,167 (Wahlstrom), 4,476,459 (Cooper et al.) and 4,531,117 (Nourse et al.). All such systems exploit a common feature, namely, that receivers for detecting the marker-produced signals are only activated during quiescent intervals between the transmitted bursts of RF. Accordingly, the much less intense signals produced by the markers are not masked by the much more intense transmitted bursts. The sensitive receivers used in the systems may, however, render the systems unduly prone to false alarms caused by radiation from other sources in the area, such as electrical motors, lights, radio and TV transmitting equipment and the like. Interference may also occur from nearby article surveillance systems, and in some cases even from transients or other spurious signals within the systems themselves. Thus, for example, as disclosed in U.S. Pat. No. 4,476,459 (Cooper et al.), some prior systems have attempted to avoid such false alarms by including detection circuits in which the rates of decay of the marker-produced signals are closely scrutinized. To further avoid interference between similar surveillance systems operating in the same area, it has also been known to hard-wire such systems together, thus ensuring synchronization of the transmitted pulses so that the transmitter produced pulses radiated by one system cannot occur during the quiescent intervals of the other system. Such interconnections have obvious drawbacks, and frequently cannot be used, particularly where the systems are to be installed in various retail stores within a single shopping mall.

SUMMARY OF THE INVENTION

The present invention is directed to an improved technique for avoiding interference, and hence false alarms or system shut-downs, caused by non-synchronized EAS systems such as defined above, operating in the same vicinity. In addition to a transmitter for providing periodic interrogation signals containing bursts of RF followed by quiescent intervals, and a receiver for detecting during the quiescent intervals, signals generated by markers, the system of the present invention includes a circuit which responds to radiated electromagnetic energy for synchronizing the production of bursts of RF by the transmitter with bursts of RF from another like system.

In one embodiment, synchronization is effected by circuits which detect radiated energy during two different time windows which are different from each other, but wherein both occur relatively late in each quiescent interval and during which no signals produced by markers would likely be present. Circuits are also provided for comparing the amplitudes of signals detected during the two time windows, and for producing a timing control signal if the difference in amplitudes exceeds a predetermined level. Another circuit responds to the timing control signal and incrementally adjusts the periodicity of the interrogation signals of the system so that it matches the periodicity of other like systems operating in the same area. The detection of signals in the two different time windows having different amplitudes enables the system to discriminate between background levels which would appear at equal intensities within both time windows, and a potential interfering signal, such as produced by another similar EAS system operating in the same vicinity, which would occur first in one of the two time windows such that the difference in detected amplitudes exceeds the predetermined level.

In practice, it has been found that even two virtually identical systems will still not have precisely the same periodicity, such that if two such systems are operating close to each other, the periodicity of the interrogation signals of one system will always be slightly lower, i.e., it will run slower than the other. It has been found preferable to speed-up the slower system such that its periodicity matches the periodicity of the other, faster system. As interfering transmitted pulses from such a faster system will be detected in a time window slightly later during each quiescent interval than would other, non-marker related signals, when the amplitude of signals detected during the second time window exceeds those detected during the first time window by the predetermined level, the timing control signal is produced. That signal in turn causes the periodicity of the slower system to be incrementally decreased by shortening the interval between transmitted bursts such that that system speeds up. Thus, for example, if the nominal periodicity of such systems is 48 $\mu$s, the occurrence of a timing control signal would cause the periodicity of the slower system to decrease to 47 $\mu$s for one complete period. After one such period, the system reverts to the original periodicity until the need for a timing control signal is again detected.

In another embodiment, rather than changing the periodicity of one system in response to detected radiated electromagnetic energy from another like system operating nearby, the periodicity is controlled in response to detected electromagnetic energy emanating from a regulated radio or television station. In this embodiment, a predetermined subcarrier frequency modulated on a carrier frequency transmitted by such a station is detected and in response, periodic gating signals having the same period as the desired interrogation signals are produced. The gating signals are used to trigger the transmitter, causing each interrogation signal to commence upon the occurrence of a gating signal. As all systems operating in the same vicinity are turned to the same broadcast carrier and detect the same predetermined subcarrier, the interrogation signals of all such systems will continue to be synchronized. Such an embodiment, is of course limited to use in those environments in which broadcast signals containing a predetermined subcarrier frequency are readily detectable.

DESCRIPTION OF THE PREFERRED EMBODIMENT

As set forth above, the present invention is the result of the recognition in the field that the operation of two similar EAS systems operating in close proximity to each other will result in interference and thereby result in false alarms and the like. It has been found that such interference can be eliminated if both of the systems are caused to operate in synchronization with each other. Such synchronization is readily effected if the two systems can be hard wired together such that synchronization pulses from a common source can be used to trigger the transmitting burst in each system. However, in many installations such a hard wired synchronization technique is not feasible. The present invention is therefore directed to a technique whereby wireless synchronization is made possible, and operates in response to the detection of radiated RF energy from a variety of transmitted sources, shown in FIG. 1 as a transmitting source 10. In one embodiment, the transmitting source may be totally unrelated to either of the EAS systems, such as produced by a commercial broadcast station or the like as will be described in detail hereinafter. Alternatively, the transmitting source may be the transmitter within the EAS systems themselves.

Figure 1:
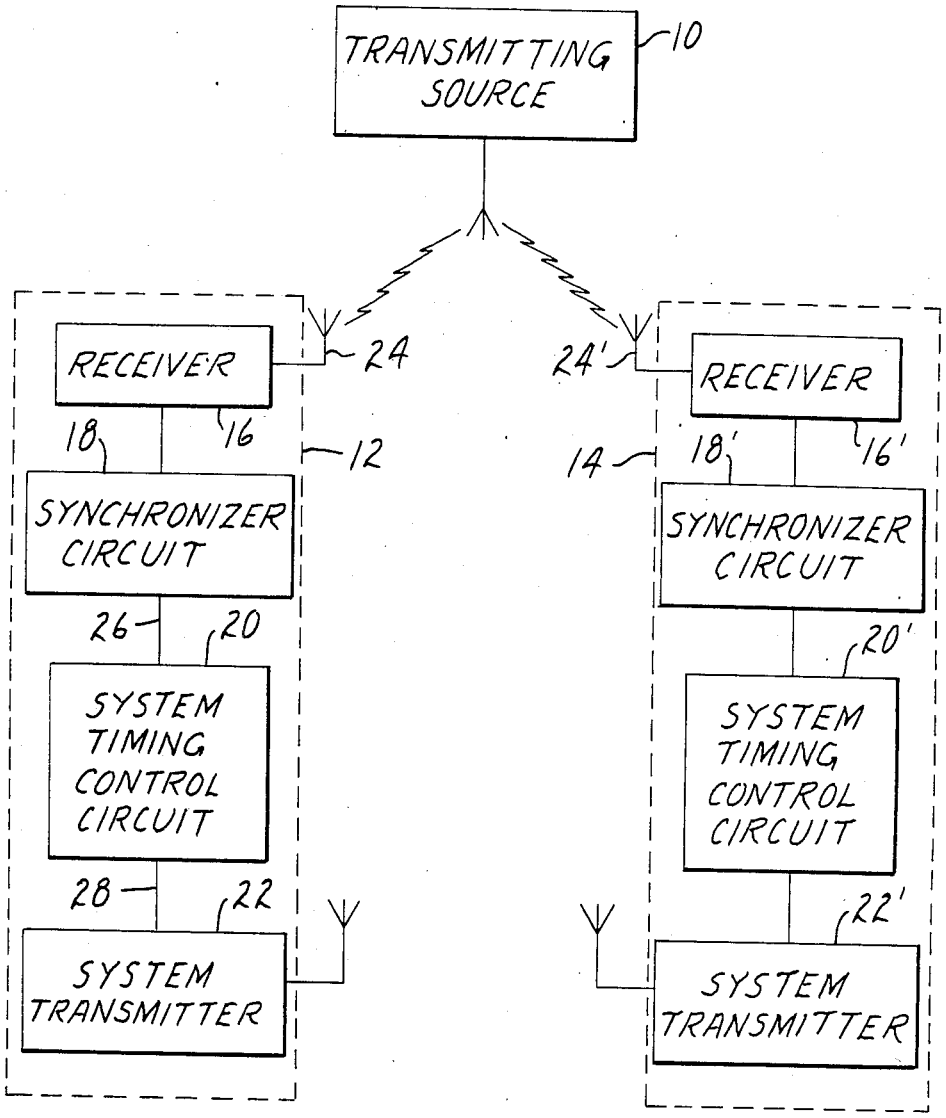
FIG. 1 is a block diagram showing two systems operating in close proximity to each other, each of which includes the system of the present invention for insuring synchronized operation.

A preferred embodiment of the present invention operating in the manner last suggested, includes like systems 12 and 14 set forth in FIG. 1. Each of the systems is there shown to include a receiver 16 and 16', a synchronizer circuit 18 and 18', a system timing control circuit 20 and 20', and a transmitter 22 and 22'.

As noted above, the present invention is for use with EAS systems of the type wherein each burst of RF energy is followed by a quiescent interval. Thus, for example, each burst of twenty microseconds duration may be followed by a twenty eight microsecond quiescent interval, for a total period of forty-eight microseconds. Thus at a nominal RF frequency of 4.5 MHz, each burst would contain approximately 90 oscillations. A circuit contained within a marker which is resonant at the transmitted RF frequency would then absorb energy during the transmit burst and the absorbed energy would continue to be radiated by the resonant circuit during the quiescent interval. The absence of the transmitted signal, which is much higher in intensity than is the signal radiated by the marker, thus enables the marker signal to be readily detected. However, if a transmitted burst from another source, such as from another EAS system operating in the same vicinity, occurs during the quiescent interval associated with the operation of the first system, that transmitted burst may be processed within the first system and thereupon result in a false alarm or in that system momentarily shutting down.

Accordingly, in the system set forth in FIG. 1, signals from a transmitting source 10, which in this embodiment could, rather than the separate transmitter illustrated in FIG. 1, the transmitter 22', are received by the receive antenna 24 and are processed within the receiver 16 to amplify and remove undesired frequency components. This preliminary processed signal is then outputted to the synchronizer circuit 18. The synchronizer circuit 18 includes timing circuits which distinguish the received signals occurring early during a quiescent interval, such as would be associated with genuine marker signals, from those occurring relatively late during the quiescent intervals and are associated with interfering noise. These late appearing signals are there processed and if interference is detected, a timing control signal is outputted on lead 26. The system timing control circuit 20 responds to the timing control signal and provides transmitter enabling signals on lead 28 to thereby control the timing of the sequence of transmitter pulses from the transmitter 22 such that all transmitted bursts from both the systems occur in synchronization.

Like the first system 12, the second system 14 also comprises a receiver 16', sync circuit 18', and system timing control circuit 20'. Thus, in a manner more fully explained below, the system 14 may also respond to transmitted signals so as to cause its transmitted bursts to be in sync with those from system 12.

Figure 2:
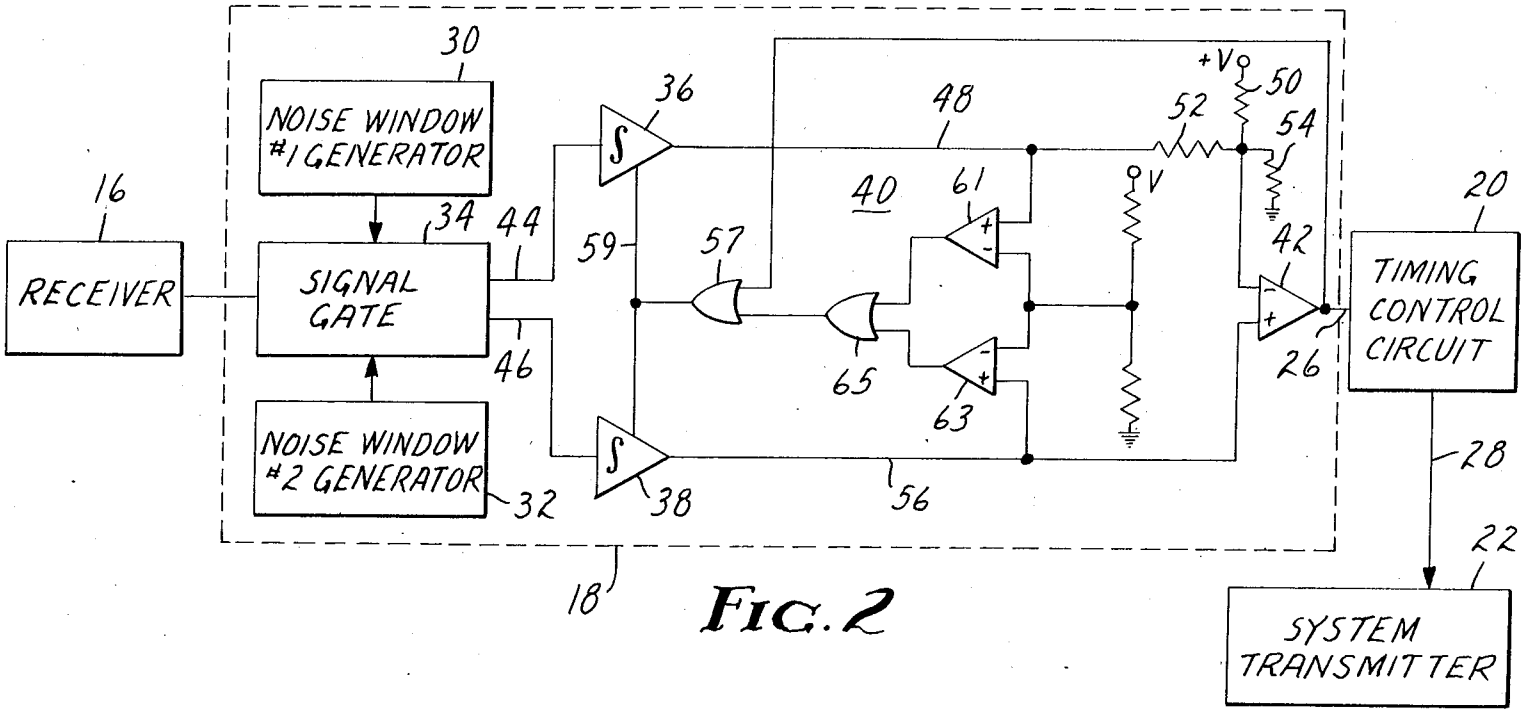
FIG. 2 is a combined block and schematic diagram of one embodiment of the present invention for enabling the synchronized operation of the systems shown in FIG. 1.
Figure 3:
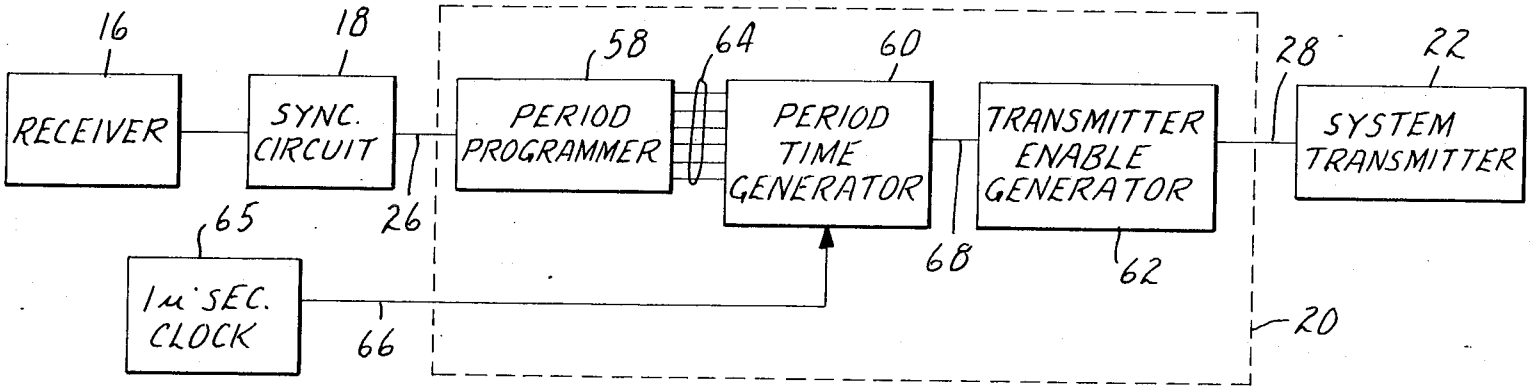
FIG. 3 is a block diagram showing a preferred timing control circuit for use in the embodiment shown in FIG. 1.

The details of a preferred embodiment in which two or more like systems operating in the same vicinity respond to transmitted bursts of the slowest of the respective systems to become at least momentarily synchronized to that system are set forth in FIGS. 2 and 3. As set forth in FIG. 2, in such an embodiment, the synchronizer circuit 18 processes the signals output from receiver 16 to produce the time control signals on lead 26 thus enabling the control within the timing control circuit 20. As may there be seen, the synchronizer circuit 18 comprises two noise window generators 30 and 32 respectively, a signal gate 34, a pair of integrators 36 and 38 respectively, a reset circuit shown generally as 40, and a comparator 42. As described in more detail with conjunction with the wave shapes set forth in FIG. 4, the noise window generators 30 and 32 respectively, respond to control signals from a master controller (not shown) to produce two time windows occurring at time intervals different from each other but both of which occur late during the quiescent interval. The signal gate 34 responds to each of the time windows produced by the generators 30 and 32 and allows only those signals as occur during each of the respective noise windows to be outputted on leads 44 and 46 respectively.

Each of those respective signals is coupled to an integrator 36 or 38 in order to accumulate signals occurring during a number of successive periods, thereby insuring adequate signal intensities for reliable subsequent processing. The output from the first integrator 36 appearing on lead 48 is coupled through a threshold adjustment network formed of resistors 50, 52 and 54, which adds a positive DC offset voltage to the integrated output. The offset output from the first integrator 36 is then coupled to one input of the comparator 42. The output of the second integrator 38 is coupled on lead 56 directly to the other input of the comparator 42. Accordingly, if the output from the second integrator exceeds that provided by the first integrator 36 by at least the amount of the offset voltage provided by the threshold adjustment network, the comparator 42 will generate the timing control signal output on lead 26.

It will also be noted that the timing control signal on lead 26 is coupled back as an input to the OR gate 57, and that the output from that gate provides an integrator reset signal on lead 59 which is coupled to the integrators 36 and 38. Accordingly, whenever a timing control signal is produced, the level of the integrators are reset so as to reinitiate the accumulation period. The other input to the OR gate 57 is provided by the automatic reset circuit 40 which comprises a pair of comparators 61 and 63, respectively, the outputs of which are coupled through another OR gate 65 and thence to the first OR gate 57. The inputs to each of the comparators 61 and 63 are provided by the outputs of the respective integrators on leads 48 and 56 and by a common sensitivity adjustment network, thereby enabling the integrators to be reset whenever the level of either integrator exceeds its saturation level.

The details of the timing control circuit 20 are set forth in FIG. 3. As may there be seen, that circuit 20 includes a period programmer 58, a period time generator 60 and a transmitter enable generator 62. Operating in a normal mode, in the absence of any timing control signal on lead 26, the period programmer 58 provides a parallel output on leads 64 corresponding to the desired units of the period length, such as, for example, a period of 48 such units. In the event a timing control signal is present on lead 26, the period programmer 58 will adjust its output to temporarily decrease the number of pulses corresponding to one period, such as, for example, to reduce it by one count to 47. The parallel output on lead 64 is coupled to a period time generator 60 which also receives one microsecond clock pulse from a 1 μsec clock 65 on lead 66. The generator 60 is preferably a variable length shift register and responds to the clock pulses to produce an output timing pulse each time a number of clock pulses corresponding to that number indicated by the parallel output on leads 64 have been received. Thus, preferably, the output timing pulses will normally occur at 8 microsecond intervals. If a timing control signal is present at lead 26, the outputs on leads 64 will correspond to 47 units and in that instance the next occurring output timing pulse will be separated by 47 microseconds from the preceding one. The output timing pulses on lead 68 are then coupled to the transmitter enable generator 62 which generates the transmit enable signal on lead 28, which signal both controls the initiation of each transmitted burst and also the point at which the transmit burst ceases. The transmit enable signal on lead 28 is coupled to the system transmitter 22 to enable oscillations produced within the transmitter to be outputted during the transmit enable period on the transmit antenna.

The output timing pulses on 68 are also coupled to additional timing and control circuits (not shown) to generate control signals used within the system, such as to control the timing within the noise window generators 30 and 32, the timing control circuit 20, etc., thereby causing the appropriate signals within the system to occur in the proper time relationships as described in conjunction with FIG. 4 hereinafter.

The manner in which the system described hereinabove adjusts its period so as to be in synchronization with a like system operating at the same vicinity is readily understood by comparing the respective wave shapes shown in FIG. 4. As may there be seen, transmit enable pulses from another system operating at a slightly faster rate, i.e., having slightly shorter periods are shown in Curve A. Likewise, the resultant output from the transmitter of that system is represented in Curve B, where it may be seen that the energy of the transmitted pulses exponentially increases during a portion of the transmit enable period, and thereafter exponentially decreases such that no transmitted energy is present at the cessation of the transmit enable pulse.

In this embodiment, the periodicity of the faster system is not altered, and the periodicity of the slower system is varied to match that of the faster system. Curves C through J thus correspond to various signals within such a nominally slower system, and show how that system is at least temporarily speeded up to be in sync with the transmitted bursts of the faster system. Thus, as shown in the first two periods shown in Curve C, the duration of those periods is slightly longer than the period for the faster system shown in Curve A. Curve C represents the receiver mute signal of the slower system, which signal is the same as the transmitter source enable signal, and causes the receiver of that system to be muted during its equivalent transmit enable period. When the mute signal goes low, the receiver is activated. Assuming that no marker produced signals are present, the output of the receiver of the slower system will contain only background noise until transmitted energy from the faster system begins to occur during the quiescent interval. This is shown to a slight extent during the first period of Curve D, and to a greater extent in the second period.

While not particularly pertinent to the present invention, Curve E shows the timing of the signal window during which a marker produced signal would be expected to occur. It will be noted that the signal window is positioned relatively early in the quiescent interval as shown in Curve C, such that the marker produced signals, which decay relatively rapidly during that interval, may be readily detected.

Of particular importance, however, to the present invention are the first and second noise windows shown in Curves F and G, respectively. As shown in Curve F, the first noise window, such as would be defined by the noise window generator 30 in FIG. 2, occurs slightly earlier than the second noise window shown in Curve G, such as would be produced by the noise window generator 32. Both of the windows are positioned relatively late during the quiescent interval. By comparing the increasing appearance of transmitter associated signals in the receiver output (Curve D), during the first two periods, it will be readily appreciated that the signal amplitude detected during the time of the second noise window will increase much more rapidly than that of the amplitude associated with the signals occurring during the first noise window. When, as is shown at the end of the second period, sufficient transmitter associated signals occur during the time associated with the second noise window such that the amplitude accumulated within the second integrator (element 38 of FIG. 2) exceeds the level accumulated in the first integrator by at least the threshold level, a timing control signal as shown in Curve H will be produced. Such a signal is outputted on lead 26 of FIG. 2. That signal is then processed as described hereinabove within the timing control circuit 20 to produce an output timing pulse on lead 68 such as shown in Curve I, which in turn generate the transmit enable pulses on lead 70. This causes the transmitted pulses produced by the system transmitter to occur as shown in Curve J with a shortened interval between the adjacent transmitted pulses as shown in the third period. Accordingly, at the beginning of the fourth period, the transmitted bursts produced by the transmitter of the first system (Curve J) are synchronized with the onset of the transmitted bursts from the second system as shown in Curve B.

Figure 4:
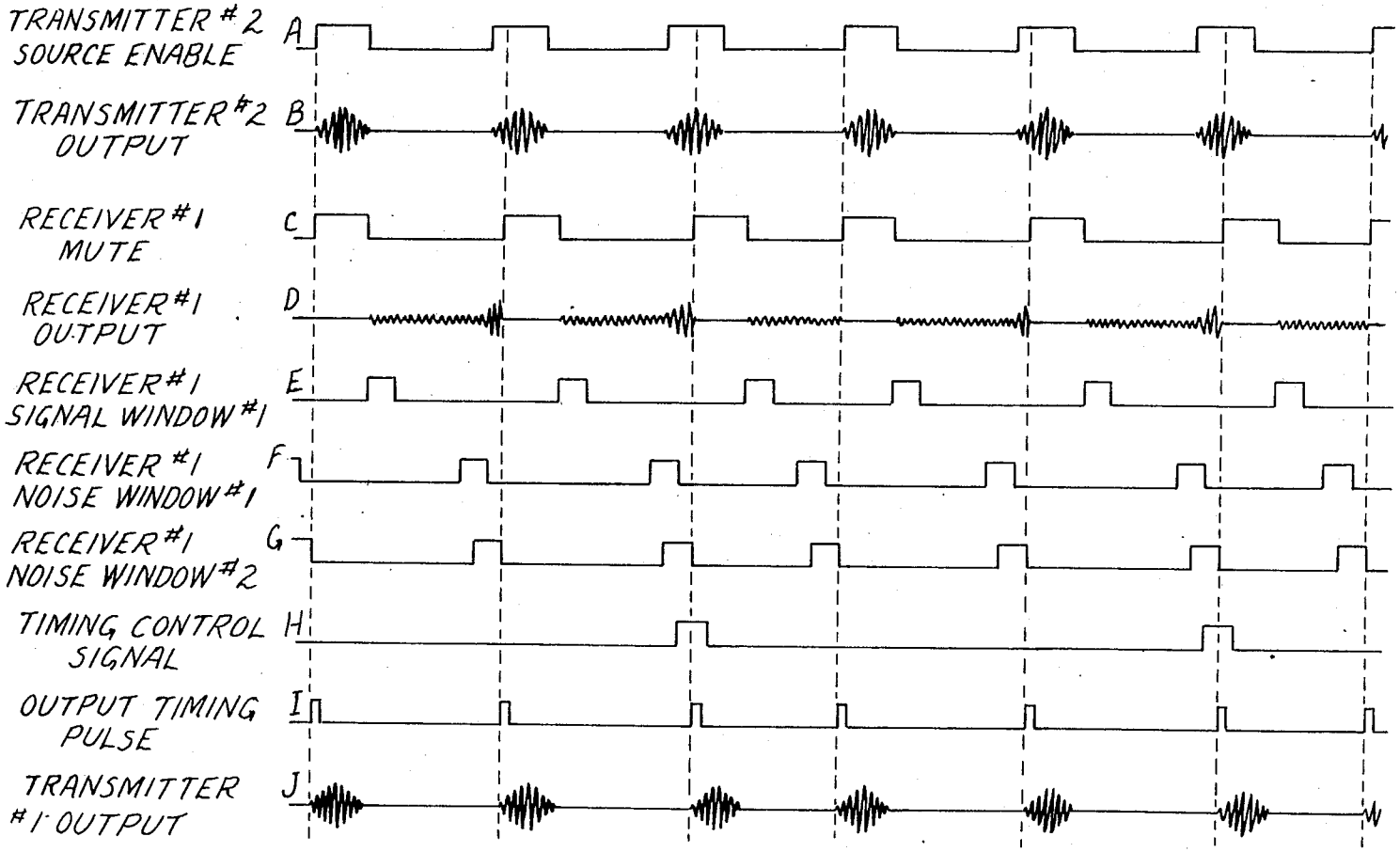
FIG. 4 shows, a succession of wave shapes produced by various portions of the systems set forth in FIGS. 1-3.

As shown in FIG. 4, following the shortened third period the operation of the slower system reverts to its original periodicity and the sequence is repeated, such that in the fourth period a slight amount of transmitted signal may be seen to be detected in the receiver output (Curve D), while in the fifth period a sufficient amount is detected such that another timing control signal ultimately results, as shown in Curve H. This process is repeated as often as necessary to keep the systems in nominal synchronization. It will be recognized that so long as all of the systems in the vicinity of each other are equipped with the synchronization circuits of the present invention, it does not matter which of the systems, are faster or slower, as the slower of the two systems will always sense the occurrence of transmitter associated signals within its noise window and temporarily adjust its periodicity to cause temporary synchronization.

Figure 5:
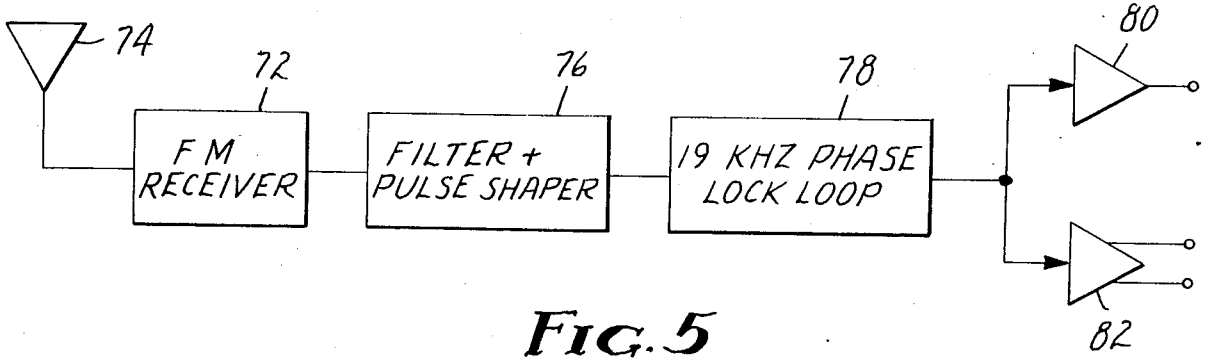
FIG. 5 is a block diagram of an alternate embodiment of the present invention.

The threshold level adjustment provided by the resistive network 50, 52 and 54 is desirably set at a point such that synchronization is reliably accomplished over a limited number of successive cycles as shown in Curve D. If the threshold level is too low, the system will reset too frequently and be susceptible to noise and other electromagnetic interference. Conversely, if the threshold level is too high, resynchronization may not occur prior to the time that some of the transmitted pulses will occur during the signal windows shown in Curve E and thereby cause false alarms. In order to clearly show the manner in which synchronization occurs, FIG. 4 depicts an extreme situation in which the periodicity of adjacent operating systems are considerably different, with the result that a timing control signal (Curve H) and hence resynchronization occurs every fourth period. In a more typical situation, the periodicity of such systems will be much more similar, hence resynchronization will occur only over widely separated intervals, such as once every several thousand periods An alternative embodiment of the present invention is shown in FIG. 5. In that embodiment, unlike the invention discussed in detail in conjunction with FIGS. 2, 3 and 4, an RF signal transmitted from a source independent of the EAS systems is utilized for synchronization. Accordingly, in such an embodiment, the 19 kilohertz subcarrier present in every FM broadcast signal may be conveniently utilized as such a source of broadcast radiation. As shown in FIG. 5, such an embodiment includes an FM receiver 72 which receives on an antenna 74 a standard FM broadcast signal. The received signal is then passed to a filter and pulse shaping network 76 which extracts the 19 kilohertz subcarrier via a phase lock loop network 78. Such a loop further reduces residual modulation or jitter typically present in the detected 19 kilohertz subcarrier and provides an indication in the event the subcarrier signal is improperly detected. The 19 kilohertz pulse sequence is then coupled to drive circuits such as a single ended line driver 80 or a dual ended driver 82, the desired output then being coupled to the transmitter unit of the EAS system to control the sequencing of the transmitted pulses. Each such system or systems to be located in the vicinity of the others would thus require such a synchronization unit. All such systems would be tuned to the same FM station as each station sends its own 19 kilohertz subcarrier which would not be in synchronism with the other subcarriers produced from other FM stations. It is particularly important that the resultant 19 kilohertz clock signals from such synchronization circuits have very small phase differences, preferably in the submicrosecond range, in order to reliably prevent interference between adjacent systems. It will also be recognized that other transmitted signals such as a television horizontal sync circuit or the like could potentially be used in a similar manner if properly processed.

We claim:

1. An electronic article surveillance system comprising transmitting means for producing in an interrogation zone periodic interrogation signals having bursts of RF followed by quiescent intervals, receiving means for detecting during said quiescent intervals a signal generated by a marker in response to said interrogation signals, and means responsive to radiated electromagnetic energy for synchronizing the production of bursts of RF by said transmitting means with bursts of RF from another like system, thereby preventing bursts of RF from said transmitting means from occurring during quiescent intervals of the interrogation signals of said another system so that such bursts cannot produce a false alarm or shut down a system as a result of being detected by the receiving means of said another system.

2. A system according to claim 1, wherein said synchronization means comprises first means for detecting radiated energy during a first time window occurring relatively late in each quiescent interval and during which no signals produced by markers would likely be present, second means for detecting radiated energy during a second time window also occurring relatively late in each quiescent period but which is different from the first zone, comparator means for comparing the amplitude of outputs from said first and second means and for providing a timing control signal in the event the difference in amplitude exceeds a predetermined level, and means responsive to the timing control signal for incrementally adjusting the periodicity of the interrogation signals of said system to cause said periodicity to match the periodicity of said other like system.

3. A system according to claim 2, wherein said first and second means include first and second integrator means respectively for accumulating signals occurring during consecutive respective time windows and wherein said comparator means includes means responsive to the accumulated outputs from said integration means for providing said timing control signal in the event a difference in amplitude of the accumulated signals exceeds a predetermined level.

4. A system according to claim 2, wherein said periodicity adjusting means comprises means for temporarily shortening said periodicity an incremental amount.

5. A system according to claim 3, further comprising means for resetting each of said integrator means in the event the amplitude of the accumulated signals in either integrator means exceeds a saturation level and in the event of the occurrence of a said timing control signal.

6. A system according to claim 1, wherein said synchronization means comprises means for detecting radiated electromagnetic energy in the form of a predetermined subcarrier frequency superimposed on a transmitted carrier frequency, means responsive to said detected subcarrier frequency for providing periodic gating signals the period of which is the same as the desired periodic interrogation signals, and means responsive to said gating signals for triggering said transmitter means to cause each interrogation signal to commence upon the occurrence of each gating signal, thereby causing the transmitting means for all like systems having means for detecting the same predetermined frequency to produce interrogation signals having the same period and synchronized RF bursts and quiescent periods.

7. A system according to claim 6, wherein said system further comprises means for locally transmitting a said carrier frequency.

8. A system according to claim 6, wherein said detecting means includes means responsive to a said predetermined subcarrier frequency superimposed on a carrier frequency broadcast by a regulated communications transmitter.

9. A circuit for synchronizing an electronic article surveillance system with other like systems, each of which produces in a respective interrogation zone periodic interrogation signals having bursts of RF followed by quiescent intervals during which marker created signals are detected, and which bursts if present during a quiescent interval of another system could be detected as a marker created signal and either shut down the system or result in a false alarm, said circuit comprising first means for detecting energy during a first time window occurring relatively late in each quiescent interval and during which no signals produced by resonating marker circuits would likely be present, second means for detecting energy during a second time window also occurring relatively later in each quiescent period but which is different from the first zone, comparator means for comparing the amplitude of outputs from said first and second means and for providing a timing control signal in the event the difference in amplitude exceeds a predetermined level, and synchronization means responsive to the timing control signal for incrementally adjusting the periodicity of the interrogation signals of said system to cause said periodicity to change so that it matches the periodicity of said other systems.

* * * * *